US006520461B1

(12) United States Patent
Graham

(10) Patent No.: US 6,520,461 B1
(45) Date of Patent: Feb. 18, 2003

(54) LEG SUPPORT

(75) Inventor: Thomas Graham, Ocean, NJ (US)

(73) Assignee: Component Hardware Group, Inc., Lakewood, NJ (US)

( * ) Notice: Subject to any disclaimer, the term of this patent is extended or adjusted under 35 U.S.C. 154(b) by 0 days.

(21) Appl. No.: 09/942,889

(22) Filed: Aug. 30, 2001

(51) Int. Cl.[7] ..... A47B 91/00

(52) U.S. Cl. ..... 248/188.8; 248/188.4; 248/157; 248/414

(58) Field of Search ..... 248/188.4, 188.5, 248/188.8, 188.9, 354.3, 354.6, 354.7, 414, 157; 16/42 T; 411/414

(56) References Cited

U.S. PATENT DOCUMENTS 2,476,366 A * 7/1949 Grimm ..... 248/188.4
2,544,504 A * 3/1951 Keys ..... 248/188
2,868,602 A * 1/1959 Dresner ..... 248/188.8
3,109,672 A * 11/1963 Franz ..... 285/334
3,355,192 A * 11/1967 Kloesel, Jr. et al. ..... 285/334
3,722,026 A * 3/1973 Wilhelmi ..... 16/42 R
4,723,109 A * 2/1988 Sheahan ..... 324/696
4,826,379 A * 5/1989 Norden ..... 411/414
5,170,972 A * 12/1992 Casals Guell ..... 16/42 T
5,588,264 A * 12/1996 Buzon ..... 108/150
5,881,979 A * 3/1999 Rozier et al. ..... 248/188.4
6,027,086 A * 2/2000 Heitlinger et al. ..... 248/188.5
6,363,685 B1 * 4/2002 Kugler ..... 52/126.6

* cited by examiner

*Primary Examiner*—Korie Chan
(74) *Attorney, Agent, or Firm*—Francis C. Hand; Carella Byrne Bain et al

(57) ABSTRACT

The leg support is constructed of a split plastic housing into which a tubular plastic foot is threaded. Metal sleeves of non-corrosive material are slidably mounted on each of the housing and foot to provide an aesthetic appearance. The internal thread on the housing is a buttress thread with a not quite perpendicular load receiving flank. The external buttress thread on the plastic foot has a mating upper flank. The leg support is able to withstand relatively heavy loads.

28 Claims, 5 Drawing Sheets

LEG SUPPORT

This invention relates to a leg support. More particularly, this invention relates to a leg support for heavy industrial equipment, such as tables, refrigerators, ice makers, ranges, and other commercial kitchen equipment.

As is known, commercial restaurants employ equipment that is made of stainless steel or other non-corrosive materials. Typically, the equipment is relatively heavy and requires leg supports of considerable strength and bulk. In addition, since the equipment may be mounted on floors of uneven contour, the equipment requires leg supports which are adjustable in height in order to permit raising and lowering of the equipment to level the top surfaces of the equipment. The leg supports must also be made of materials that can be readily cleaned and that will not corrode over a period of time due to frequent cleanings with corrosive materials.

Typically, the leg supports have been made of relatively large metal elements in order to be able to carry the weight of the equipment while also satisfying the requirements for non-corrosion. However, these metal leg supports are relatively expensive to manufacture.

Attempts at making the leg supports of a plastic material to reduce the manufacturing cost have not been successful in producing a leg support which is capable of withstanding relatively heavy loads.

Accordingly, it is an object of this invention to provide an adjustable leg support of non-metallic materials which is capable of supporting heavy loads.

It is another object of the invention to provide a leg support with plastic load-bearing elements which are capable of bearing large loads.

It is another object of the invention to be able to provide a low-cost leg support of non-metallic elements which can carry relatively heavy loads.

It is another object of the invention to provide a non-corrosive adjustable leg support of high load bearing capacity and low cost.

Briefly, the invention is directed to a leg support which is comprised of a plastic housing having an upper support surface for receiving a load and a plastic foot threadably mounted in the housing and extending from one end of the housing. In accordance with the invention, the housing has an internal buttress thread and the foot has an external buttress thread threadably mounted in the internal buttress thread.

In accordance with the invention, the mating relationship between the two buttress threads is such that the internal thread of the plastic housing transfers the weight of a supported structure, e.g. a table, directly to the external thread on the plastic foot via the load receiving flank which is nearly perpendicular to the vertical axis of the plastic housing.

The lower load receiving flank of the internal thread of the housing is so nearly perpendicular to the thread axis that the radial component is reduced to a minimum. Preferably, the load receiving flank is disposed on an upwardly directed angle of from 1° to 7° relative to a horizontal plane.

The support surface on the housing is an annular surface and a metal bolt is mounted in the housing concentrically of the annular surface to extend from an opposite end of the housing for securement to a table leg or other supported structure.

The plastic housing is a longitudinally split housing formed of two longitudinally disposed pieces. The housing pieces are basically mirror images of each other except as described below. Each housing piece has a portion of the internal thread formed thereon and each has a recess for receiving one-half of the head of the bolt therein. In addition, a sleeve, for example, of metal, such as stainless steel, or other non-corrosive material is disposed over and coaxially of the housing for holding the two housing pieces together and for providing a smooth pleasing outward appearance.

When a load is transmitted onto the housing via the contact surface, the two housing pieces do not have a tendency to spread apart as would be the case with a conventional V thread form arrangement because of the not quite perpendicular nature of the internal thread of the housing on the not quite perpendicular flank of the external thread on the plastic foot.

The plastic housing is also provided with a plurality of circumferentially disposed reinforcing ribs which are disposed in facing relation to the sleeve. In addition, at least some of these ribs are of a greater outer diameter than the inner diameter of the sleeve so as to be deformed inwardly and downwardly between the sleeve and the housing when the sleeve is slid into place and to thereby frictionally hold the sleeve on the housing. In addition, the larger size ribs serve to adjust to sleeves of different inside diameter.

The plastic foot has a lower shank section of cylindrical shape which extends out of the plastic housing and is provided with a plurality of circumferentially disposed reinforcing ribs to deform and slidably receive a sleeve in friction fit manner. The external thread on the plastic foot is disposed on an upper section of the foot that is retained at all times within the plastic housing.

The sleeve disposed over the shank of the foot is of stainless steel or other non-corrosive material and is provided for aesthetic purposes. That is to say, the sleeve provides an aesthetic appearance without being a load-bearing member.

The plastic foot is hollow and has an end cap snap-fitted onto the bottom of the shank section in relatively rotatable manner in order to provide an enlarged bearing surface on a floor or other support surface. The cap has a greater outside diameter than the plastic foot and abut or be slightly spaced from the metal sleeve on the plastic foot.

The overall appearance of the leg support is provided by the two metal sleeves which are disposed about the plastic housing and plastic foot. In addition, the two sleeves present non-corrosive surfaces which can be easily cleaned by the usual cleaning solutions.

These and other objects and advantages of the invention will become more apparent from the following detail description taken in conjunction with the accompanying drawings wherein.

Figure 1:
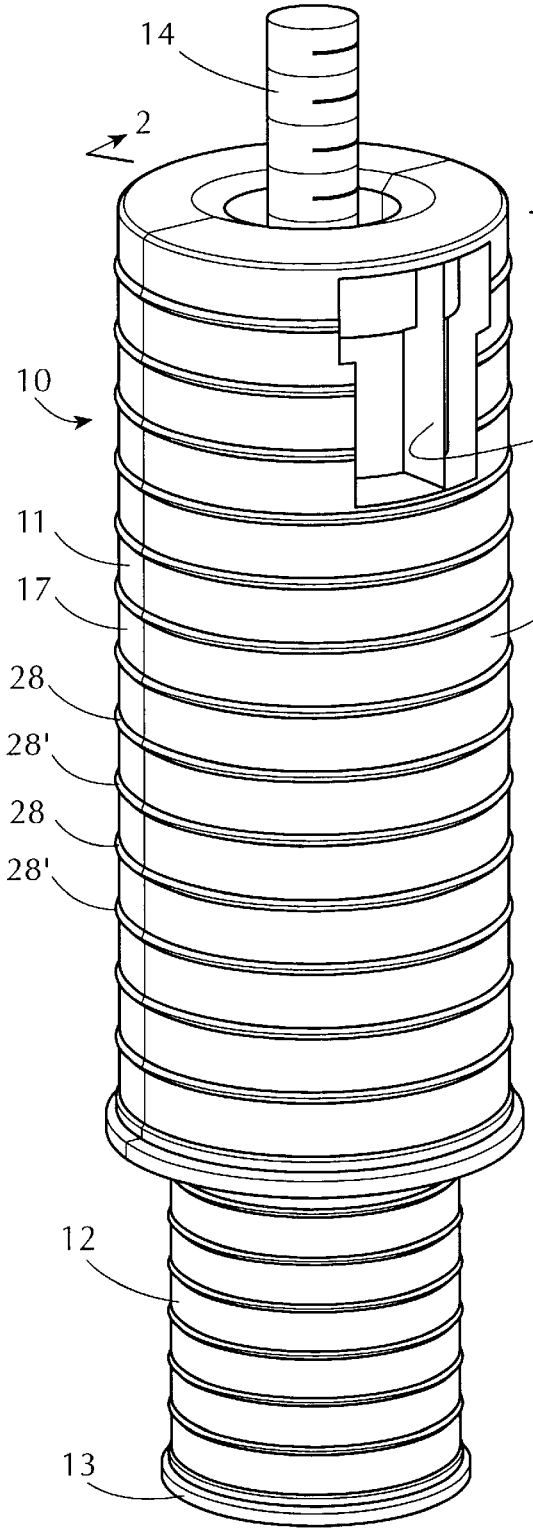
FIG. 1 illustrates a perspective view of a leg support constructed in accordance with the invention before placement of the outer metal sleeves thereon.
Figure 4:
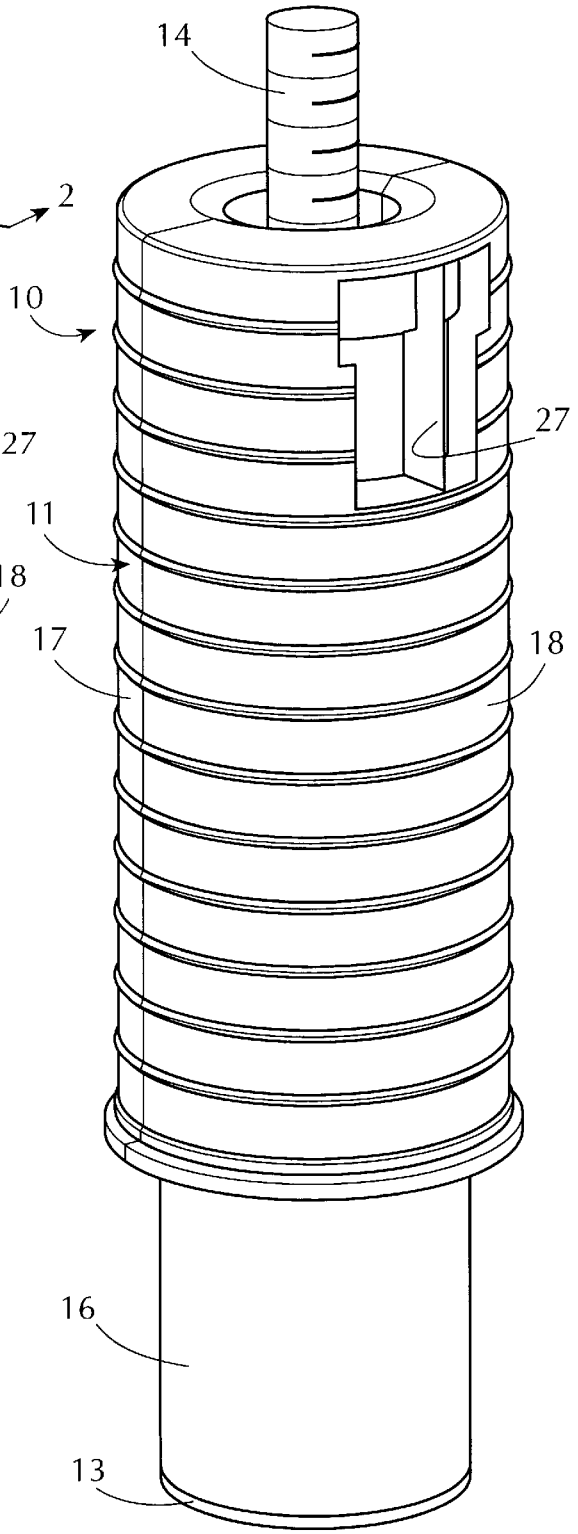
FIG. 4 illustrates a view similar to FIG. 1 of the leg support with the sleeve in place on the foot.

Referring to FIG. 1, the leg support 10 includes a split plastic housing 11 of tubular shape, a tubular plastic foot 12 threadably mounted in the housing 11, an end cap 13 secured to the bottom of the foot 12 and a bolt 14 mounted in and extending out of the top of the housing 11.

Figure 9:
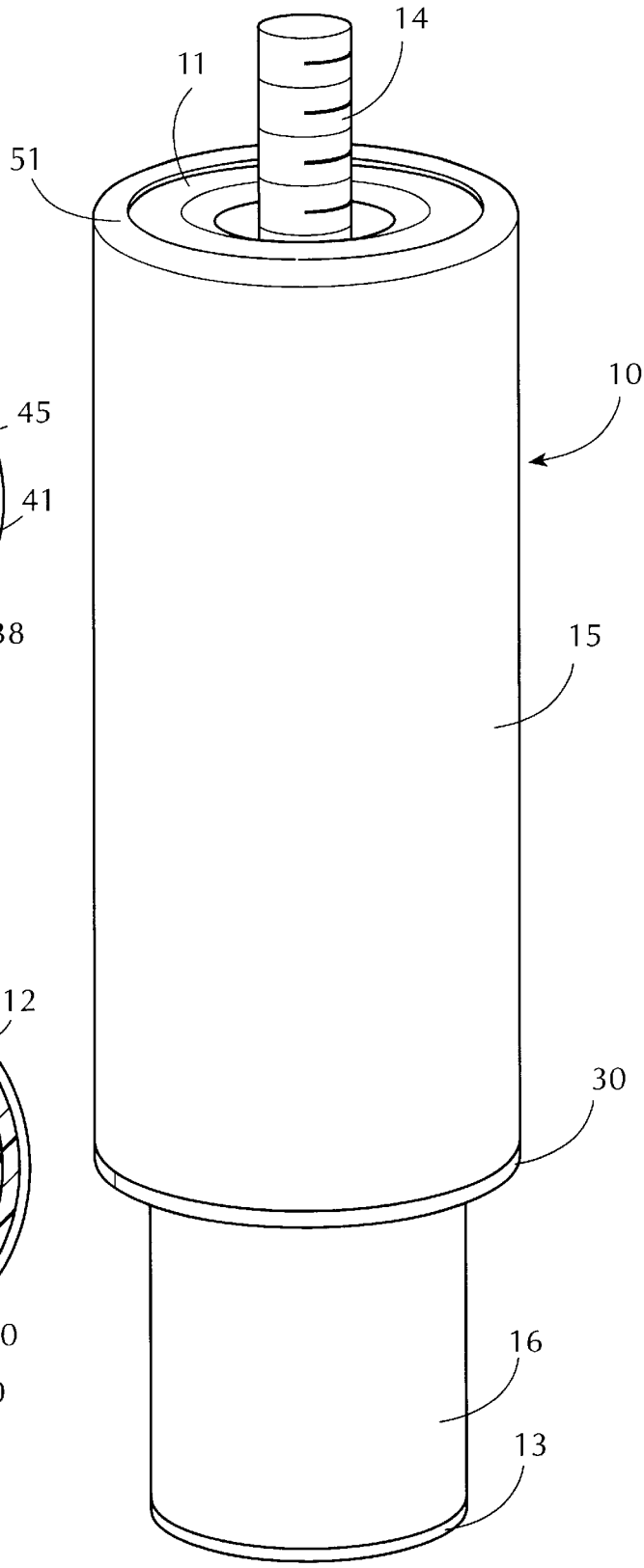
FIG. 9 illustrates a perspective view of the leg support in assembled condition in accordance with the invention.

Referring to FIG. 9, the leg support 10 also includes a pair of stainless steel or other non-corrosive material metal sleeves 15, 16, one of which is forcibly disposed over the housing 11 while the other sleeve 16 is forcibly disposed over the foot (not shown).

Figure 3:
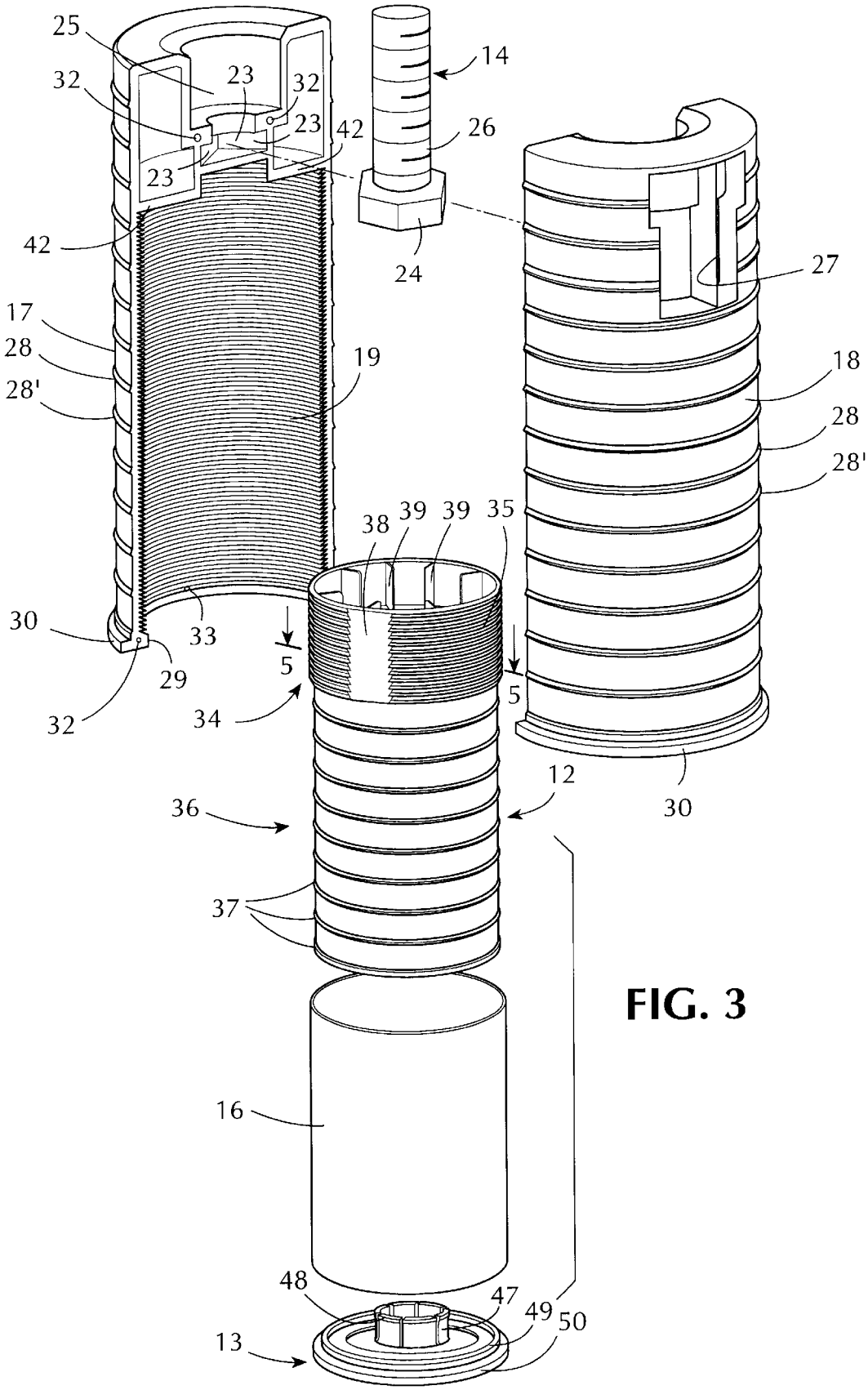
FIG. 3 illustrates an exploded view of the leg support component of FIG. 1 together with a sleeve for the foot of the leg support.

Referring to FIG. 3, the split housing 11 is formed of two pieces 17, 18 which are molded in a form to be abutted together along a longitudinal axis. As illustrated, each piece 17, 18 is formed with an internal buttress thread 19 which continues from one piece to the other.

Figure 8:
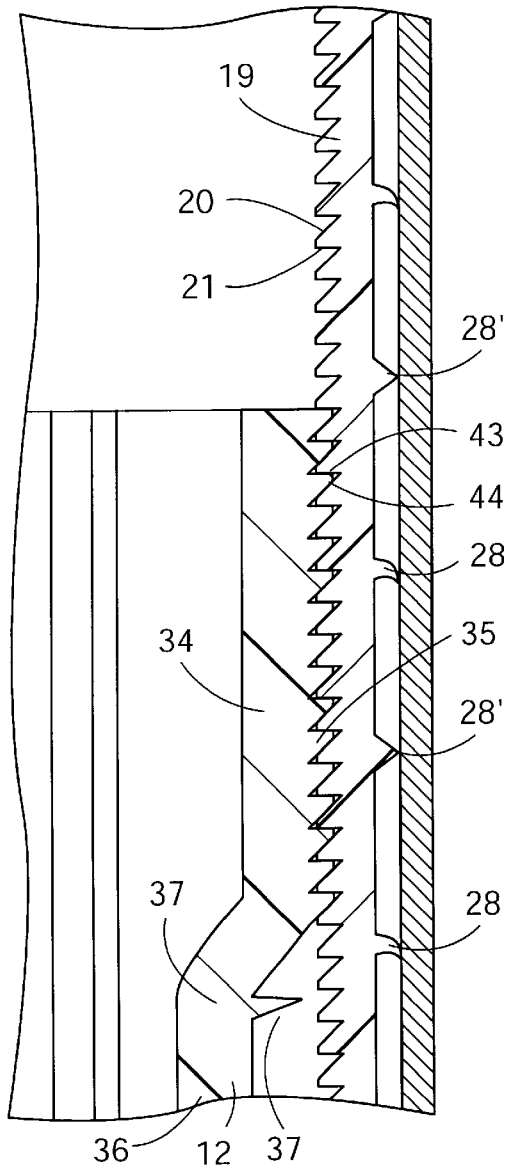
FIG. 8 illustrates an enlarged view of the threaded relationship between the housing and foot in accordance with the invention.

As illustrated in FIG. 8, the internal buttress thread 19 of the plastic housing 11 has a pair of flanks 20, 21. The upper flank 20, as shown, is disposed on an angle of typically 45 degrees relative to a horizontal plane while the lower load receiving flank 21 is disposed at an upwardly directed angle of from 1 degree to 7 degrees and, typically 7 degrees, relative to a horizontal plane.

As shown in FIG. 3, each housing piece 17, 18 is provided with internal walls 23 that define a hemi-hexagonal recess to receive one half of a hexagonal head 24 of the bolt 14. Each recess is provided with four flat walls to mate against corresponding walls on the hexagonal head of the bolt. In addition, each housing piece 17, 18 has an internal wall 25 to define a semi-circular recess at the upper end of the housing piece through which a threaded stem 26 of the bolt 14 extends to be threaded into a table leg or the like.

Each housing piece 17, 18 may also be provided with a recess 27 on the outer surface in order to save material and weight and reduce shrinkage of the plastic during molding.

Each housing piece 17, 18 is provided with a plurality of vertically spaced apart circumferentially disposed ribs 28, 28'. These ribs 28, 28' extend radially outwardly with the alternating ribs being of different radial length for purposes as described below with respect to FIG. 7.

The internal thread 19 in each piece 17, 18 of the housing 11 extends to near the lower end of the housing piece 17, 18 and a smooth cylindrical surface is formed on the inside of the bottom of each piece 17, 18. Correspondingly, a radially outwardly directed shoulder 30 is formed at the bottom end of each piece 17, 18.

The housing pieces 17, 18 are provided with mating pins (not shown) and recesses 32 in order to align the two pieces 17, 18 when the two pieces 17, 18 are brought together.

Figure 7:
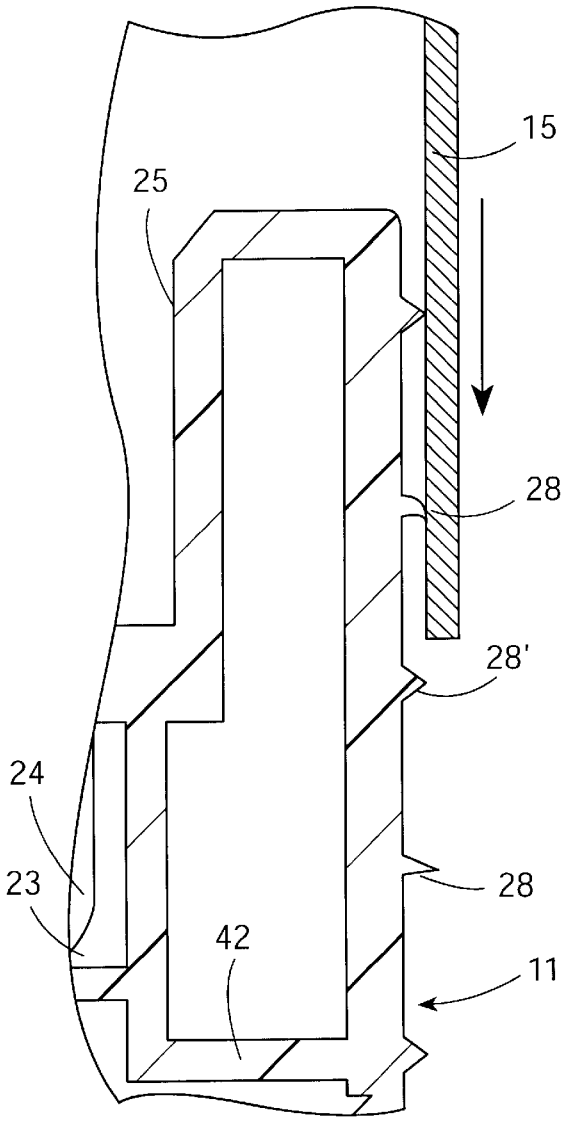
FIG. 7 illustrates a partial view of the housing during fitting of the metal sleeve thereon.

Referring to FIG. 7, the longer ribs 28 on the housing pieces 17, 18 are constructed to be deformed when the sleeve 15 is slidably mounted thereover. As illustrated, the alternating ribs 28 are each deformed downwardly between the sleeve 15 and the housing 11 so as to frictionally hold the sleeve 15 on the housing 11. In order to facilitate deformation, each rib 28 has an upper flank disposed on an angle relative to a horizontal plane which is greater than the lower flank. For example, the upper flank is disposed on an angle of 11° and the lower flank is disposed on a lower angle of 1° (see FIG. 7).

When the sleeve 16 is advanced in the direction indicated in FIG. 7, the ribs 28 deflect axially and the plastic thereof is forced beyond its yield point to cause permanent deformation of the ribs 28. This axial deformation minimizes radial force applied inwardly to the cylindrical portion of the housing 11 which would otherwise cause reduction of the diameter of the housing 11, and consequent tightness of the thread interface. Although permanently deformed, the ribs 28 still apply a force equal to the deformation force on the inside diameter of the sleeve 15 and at an angle from the perpendicular such that a force applied opposite the direction of assembly creates a "fishhook barb" situation which retains the sleeve 15 against a removal force greater than the assembly force.

The smaller ribs 28' on the housing 11 are closely sized to be just under the inside diameter of the sleeve 15 so as to minimize radial outward deflection of the housing pieces 17, 18 as a result of applied axial load to the housing 11.

Referring to FIG. 3, the plastic foot 12 is of tubular construction and is provided with an enlarged section 34 at the upper end having an external buttress thread 35 thereon and a depending shank section 36 of cylindrical shape which is provided with a plurality of circumferentially disposed reinforcing ribs 37. The external thread 35 is non-continuous and is interrupted at two diametrically disposed areas 38 to form smooth flat surfaces for purposes as described below.

The reinforcing ribs 37 are radially outwardly directed and are of tapered cross-section. As indicated in FIG. 3, the ribs 37 are sized in the same manner as the ribs 28 in order to be deformed upon assembly of the sleeve 16 in place. In this respect, the ribs 37 have a lower flank disposed on an angle relative to a horizontal plane greater than the upper flank thereof to facilitate bending of the ribs 37 upon sliding of the sleeve 16 thereover from the bottom of the foot 12 towards the top of the foot 12. As with ribs 28, the ribs 37 are permanently deformed and provide for a tight fit of the sleeve 16 of the foot 12. Also, the sleeve 16 is retained on the foot 12 against a removal force greater than the assembly force.

Typically, the ribs 37 have a lower flank disposed on an angle of 15° and an upper flank disposed on an angle of 1° (see FIG. 8). Usually, the 1 degree slope is required for molding purposes.

The tubular foot 12 is also provided with a plurality of longitudinally disposed reinforcing ribs 39 on an inside wall for reinforcement purposes. These ribs 39 are tapered in thickness, increasing in thickness from top to bottom and terminate in a flat floor or base 40 (FIGS. 5 and 6) of the foot 12. An upstanding annular lip 41 extends upwardly from the base 40 to overlap the ends of the ribs 39 (see FIG. 2).

The external thread 35 of the plastic foot 12 is sized to threadably mate with the internal thread 19 of the plastic housing 11. In addition, the vertical extent of the external thread 35 is a minor fraction of the length of the internal thread 19. This allows the plastic foot 12 to be threaded into and out of the housing 11 over a substantial length.

In order to prevent the foot 12 from being unscrewed from the housing 11, the external thread 35 on the foot 12 is abruptly terminated with a full profile perpendicular surface at the lower end, for example, at 50° from a flat area 38. The female thread 19 on the housing 11 is abruptly stopped on the housing piece 17 at a point 33. The two ends of the threads 19, 35 thus form a stopping means to prevent rotation of the foot 12 in a direction out of the housing 11. When the foot 12 is unthreaded relative to the housing 11, a perpendicular surface (not shown) at the lower end of the thread 35 abuts the end of the internal thread 19 of the housing 11. Thus, the foot 11 is prevented from being unthreaded beyond this point. A definite tactile "feel" occurs when contact occurs.

In addition, the housing pieces 17, 18 are formed with reduced inside diameters at the lower ends of the threaded sections such that a much greater turning force is required in order to unthread the foot 12 from the housing 11. This is due to the fact that the male thread 35 would be crushed as the male thread 35 is forced into the reduced diameter aperture of the housing 11. Additionally, the outer periphery of each of the housing pieces 17, 18 is reinforced in this area by an outside ring of material 30 which, in turn, is prevented from expanding by a snug fit in the stainless steel sleeve 15.

Interior walls 42 of the housing 11 at the upper end of the internal thread 19 serve as a stop against the foot 12 to prevent further rotation of the foot 12 into the housing 11.

Referring to FIG. 8, the external thread 35 on the foot 12 has an upper flank 43 not quite perpendicular to the longitudinal vertical axis of the foot 11 and a lower flank 44 is disposed on a downwardly directed angle relative to the longitudinal axis.

Referring to FIG. 3, the sleeve 16 has an outer diameter less than the inside diameter of the external thread 19 of the housing 11 so as to be telescopically received within the housing 11.

Figure 5:
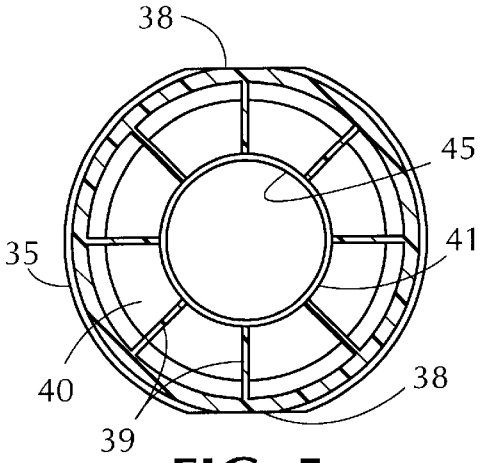
FIG. 5 illustrates a view taken on line 5—5 of FIG. 3.
Figure 6:
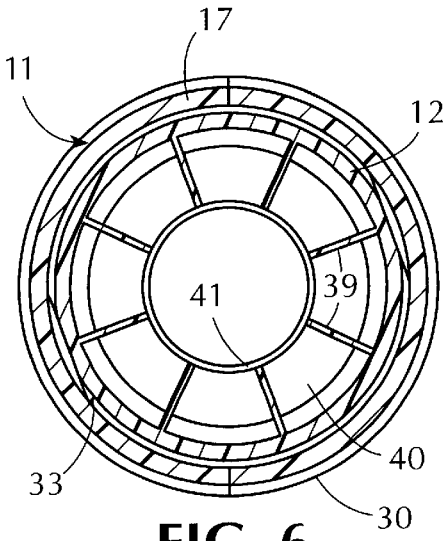
FIG. 6 illustrates a view taken on line 6—6 of FIG. 2.

Referring to FIG. 5, the flat areas 38 formed on diametric sides of the foot 12 are at the parting line. The purpose of the flat areas is to ensure a smooth feel as the parting lines of the external and internal threaded parts pass each other. Without these flat areas, a distinct "click" would be felt.

The lip 41 in the bottom of the foot 12 forms a circular opening 45 to receive the end cap 13.

The end cap 13 has a centrally recessed flat base 46 with an upstanding slotted circular stem 47. Each section of the stem 47 is provided with an outwardly directed lip 48 which allows the stem 47 to pass through the circular opening 45 in the bottom of the foot 12 and to be snap-fitted onto the lip 41 in such a way as to enable free rotation of the end cap 13 with respect to the foot 12, yet retain the end cap 13 axially. The end cap 13 provides an enlarged bearing surface for the leg support 10 on a support surface, such as a floor, and permits the foot 12 to rotate with respect thereto as the height is adjusted.

Referring to FIG. 9, the sleeve 15 is of tubular shape and has a turned-in upper lip 51 to rest on the top of the housing 11. In addition, the inside diameter of the sleeve 15 is sized to slide over the split housing 11 in friction-fit manner. In this respect, the larger alternating ribs 28 on the outside of the housing 11 have an outside diameter more than the inside diameter of the sleeve 15. Thus, when the sleeve 15 is slid over the housing (see FIG. 7), these larger ribs 28 deform downwardly to increase the friction fit between the sleeve 15 and the housing 11 as explained above.

When in place, the metal sleeve 15 serves to hold the two pieces 17, 18 of the housing 11 together while providing a smooth aesthetic appearance.

The second sleeve 16 is of cylindrical shape having a constant thickness and is of an inside diameter which allows the sleeve to slide over the ribs 37 on the foot 12 in friction-fit manner. In addition, the sleeve 16 is of a length to cover over the shank section 36 of the foot 12 and to abut against the enlarged threaded section of the foot 12. The end cap 13 is sized to have a diameter slightly greater than the sleeve 16.

In order to assemble the parts of the leg support 10, the bolt 14 is first placed in one piece 17 of the housing 11. At the same time, the foot 12 is laid into the same housing piece 17 with the threads 19, 35 in engagement. Next, the second piece 18 of the housing 21 is placed in engagement with the first piece 17 over the bolt 14 and foot 12. Thereafter, the sleeve 15 is forcibly slid over the housing 11 in order to secure the housing pieces 17, 18 together. At the same time, the bolt 14 is retained in place and the foot 12 is retained in place.

If the second sleeve 16 has not been placed over the foot 12, that sleeve 16 is now forcibly slid into place to deform the ribs 37 and to abut the enlarged thread section on the foot 12. The end cap 13 is then snap fitted into place.

The assembled leg support 10 can then be secured to a leg of a piece of equipment by threading the bolt 14 into a suitable threaded socket of the table leg until the lip 51 of the sleeve 15 abuts the undersurface of the equipment. Thereafter, the foot 12 may be rotated within the housing 11 to raise or lower the leg in order to level the equipment or for any other purpose.

Figure 2:
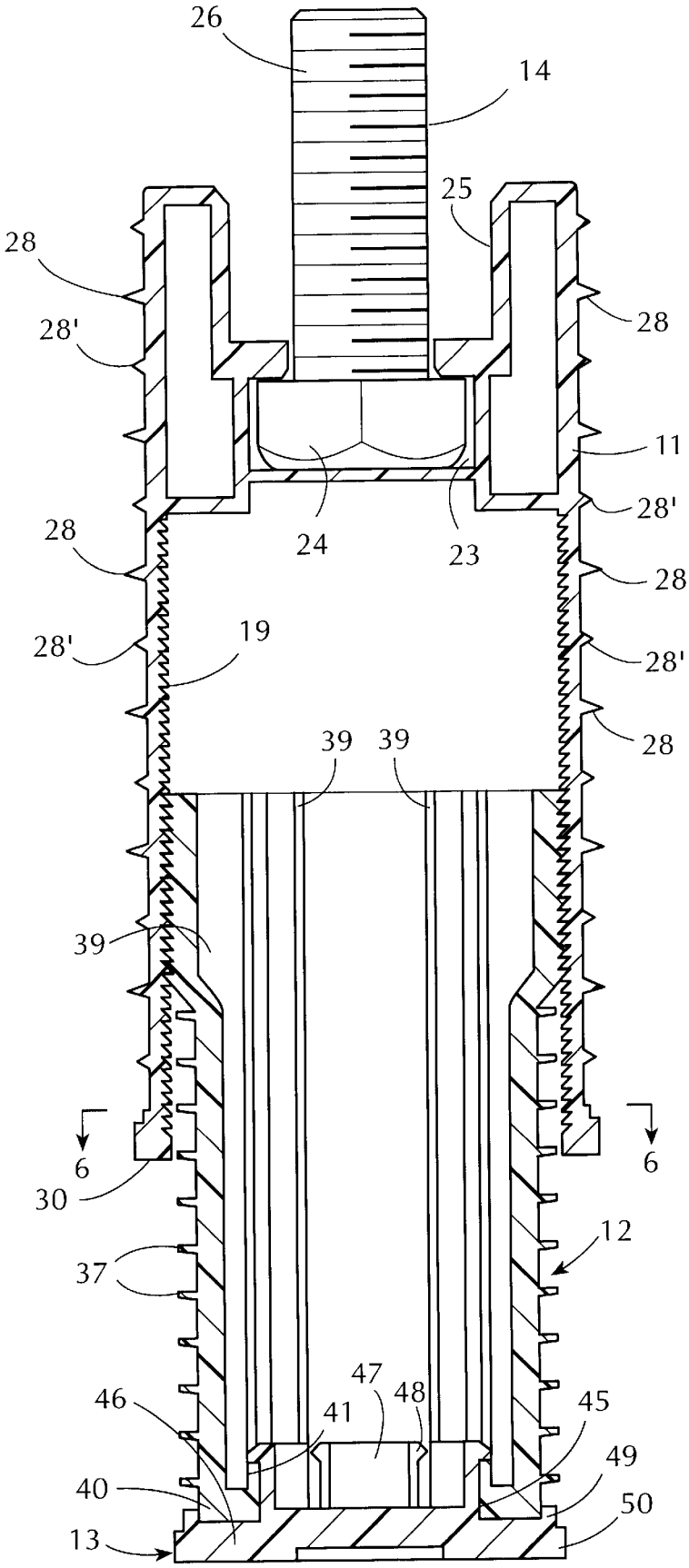
FIG. 2 illustrates a cross-sectional view of the leg support components taken on line 2—2 of FIG. 1.

Referring to FIG. 2, when a load is placed on the leg support 10, the load is transferred via the turn-in lip 51 on the sleeve 15 to the support surface at the top of the housing 11.

The load is then transferred from the housing 11 to the foot 12 via the threads 19, 35. To this end, it has been found that a conventional thread on the housing 11 and the foot 12 would not transfer the load properly. Instead, the threads on the two housing pieces would separate sufficiently from each other to allow the housing to slide down the foot. The shape of the threads, for example as shown in FIG. 8, eliminates this problem. Thus, the load is readily transferred from the internal thread 19 of the housing 11 to the external thread 35 on the foot 12 and then transferred to the remainder of the foot 12 to the end cap 13

The leg support has been tested to 6,000 pound. In this respect, the dimensions of the various components of the leg support are as follows:

| |
|---|
| Housing 11 |
| Outside diameter: 2.50 inches |
| Inside diameter: 2 1/32 inches (at wall 25) |
| Size of the thread from root to apex: 1/16 inches. |
| Foot 12 |
| Outside diameter at enlarged end: 2 1/8 inches |
| Inside diameter at enlarged end: 1 7/8 inches |
| Thread size from root to apex: 1/16 inches |
| Shank section 36 |
| Outside diameter: 1 3/4 inches |
| Inside diameter: 1 1/2 inches |
| Length: 4 inches |
| End cap 13 |
| Inside diameter: 2 1/16 inches |
| Metal bolt 14 |
| Outside diameter: 3/4 inches |

The snap-in end cap 13 is rotatable within the foot 12 to allow the foot 12 to rotate in place while the end cap 13 remains fixed relative to a support, such as the floor.

The leg support 10 has several advantages over previously known leg supports. For example, the split housing 11 is made in two easily molded half pieces 17, 18. These two pieces 17, 18 readily assemble over the tubular plastic foot 12 and the attaching bolt 14. Further, the tubular sleeve 15 readily presses over the two pieces 17, 18, permanently and easily keeping everything properly aligned and assembled.

The unique circumferential rib configuration of the ribs 28, 28' on the housing pieces 17, 18 minimizes radial compressive force and resultant thread tightening. The sleeve 15 also minimizes radial expansion and separation of the half housing pieces 17, 18. This is accomplished by a combination of the unequal angle, deflecting ribs 28 and the close-but-not-touching ribs 28'.

The combination of alternating deforming ribs 28 and close-but-not-deforming ribs 28' is purposely done in order to minimize any tendency to compress the female threads of the housing pieces 17, 18 inwardly while also preventing radial expansion and consequent loosening of the engagement between the female threads and male threads. At the same time, the unequal-angle, tapered deforming ribs 28 provide retention, not by compressive force, but by cantilever axial bending action off the wall and the exertion of axial friction against the sleeve 15 in addition to radial friction and compression.

The fact that flexing occurs on the tapered shape of a rib 28, which rib is substantially thinner than the wall thickness, minimizes compression forces on the cylindrical wall onto the plastic foot 12 within and creates a significant frictional force to aid retention of the sleeve 15.

Thus, a close fit of the sleeve 15 is obtained to keep the plastic housing pieces 17, 18 accurately together without squeezing the pieces so tightly as to compress the female threads and still maintain enough frictional force to firmly hold the sleeve 15 in place.

The invention thus provides a leg support of plastic components which is able to carry a relatively large load.

The invention further provides a leg support which can be manufactured in an economical manner.

What is claimed is:

1. A leg support comprising a plastic housing disposed on a vertical axis and having an internal buttress thread and an upper support surface for receiving a load, said internal buttress thread having a lower load resisting flank disposed on an upwardly directed angle of from 1° to 7° relative to a horizontal plane for transferring the load therethrough and an upper flank disposed on a downwardly directed angle relative to said vertical axis and a plastic foot having an external buttress thread threadably mounted in said internal thread of said housing and extending from one end of said housing, said external buttress thread having an upper load-resisting flank disposed in mating engagement with said lower flank of said internal thread to receive the load therefrom and a lower flank disposed on a downwardly directed angle relative to said vertical axis of said housing.

2. A leg support as set forth in claim 1 wherein said support surface is annular and which further comprises a bolt mounted in said housing concentrically disposed within said annular surface and extending from an opposite end of said housing.

3. A leg support as set forth in claim 2 wherein said housing is formed of two longitudinally disposed pieces, each said piece having a portion of said internal thread formed thereon and having a recess receiving a head of said bolt therein.

4. A leg support as set forth in claim 3 which further comprises a sleeve disposed over and coaxially of said housing for holding said housing pieces together.

5. A leg support as set forth in claim 4 wherein said housing has a plurality of circumferentially disposed reinforcing ribs thereon in facing relation to and frictionally engaging said sleeve.

6. A leg support as set forth in claim 5 wherein at least one of said ribs is deformed downwardly between said sleeve and said housing for frictionally holding said sleeve on said housing.

7. A leg support as set forth in claim 6 wherein said one rib has an upper flank disposed on an angle relative to a horizontal plane greater than a lower flank thereof to facilitate bending of said one rib in response to sliding of said sleeve thereover in a direction from said upper flank toward said lower flank.

8. A leg support as set forth in claim 3 wherein one of said housing pieces has a plurality of pins projecting therefrom and the other of said housing pieces has a plurality of recesses receiving said pins to align said housing pieces together.

9. A leg support as set forth in claim 1 wherein said foot has a plurality of outwardly directed circumferential ribs thereon and which further comprises a sleeve concentrically mounted on said foot in frictional engagement with said ribs.

10. A leg support as set forth in claim 1 wherein at least one of said housing and said foot has a first plurality of circumferentially disposed ribs thereon for receiving a sleeve thereon, at least one of said ribs having a first flank disposed on an angle relative to a horizontal plane greater than a second flank thereof to facilitate bending of said one rib in response to sliding of a sleeve thereover in a direction from said first flank toward said second flank.

11. A leg support as set forth in claim 10 wherein said first flank is disposed on an angle of 11° and said second flank is disposed on an angle of 1°.

12. A leg support as set forth in claim 10 wherein said first flank is disposed on an angle of 15° and said second flank is disposed on an angle of 1°.

13. A leg support as set forth in claim 10 wherein said housing has a second plurality of circumferentially disposed ribs thereon of smaller outside diameter than said first plurality of ribs thereon, said second plurality of ribs being disposed in alternating relation to said first plurality of ribs.

14. A leg support as set forth in claim 1 further comprises a thread stopping means on said housing for obstructing rotation of said foot out of said housing.

15. A leg support as set forth in claim 14 wherein said thread stopping means includes a stop formed at a bottom part of said internal thread of said housing and a vertical abutment surface formed at an end of said external thread of said foot.

16. A leg support comprising a plastic housing disposed on a vertical axis and having an internal buttress thread and an upper support surface for receiving a load, said internal buttress thread having a lower load resisting flank disposed on an upwardly directed angle of from 1° to 7° relative to a horizontal plane for transferring the load therethrough and an upper flank disposed on a downwardly directed angle relative to said vertical axis; and a plastic foot having an external buttress thread threadably mounted in said internal thread of said housing and extending from one end of said housing, said external buttress thread having an upper load-resisting flank not quite perpendicular to said vertical axis and disposed in mating engagement with said lower flank of said internal thread to receive the load therefrom and a lower flank disposed on a downwardly directed angle relative to said vertical axis of said housing.

17. A leg support comprising a longitudinally split two piece plastic housing disposed on a vertical axis and having an internal buttress thread and an upper support surface for receiving a load, said internal buttress thread having a lower load resisting flank for transferring the load therethrough and an upper flank disposed on a downwardly directed angle relative to said vertical axis;

a tubular plastic foot having an external buttress thread threadably mounted in said internal thread of said housing and extending from one end of said housing, said external buttress thread having an upper load-resisting flank disposed in mating engagement with said lower flank of said internal thread to receive the toad therefrom and a lower flank disposed on a downwardly directed angle relative to said vertical axis of said housing; and a sleeve slidably disposed over said housing in friction fit relation and having an inwardly directed lip at an upper end in contact with said upper support surface of said housing to transfer a load thereto.

18. A leg support as set forth in claim 17 which further comprises a bolt mounted in said housing concentrically of said upper support surface and extending from an opposite end of said housing for threaded securement to a table.

19. A leg support as set forth in claim 17 wherein said housing has a plurality of circumferentially disposed reinforcing ribs thereon in facing relation to and frictionally engaging said sleeve and wherein at least one of said ribs is deformed downwardly between said sleeve and said housing for frictionally holding said sleeve on said housing.

20. A leg support as set forth in claim 19 wherein said one rib has an upper flank disposed on an angle relative to a horizontal plane greater than a lower flank thereof to facilitate bending of said one rib in response to sliding of said sleeve thereover in a direction from said upper flank toward said lower flank.

21. A leg support as set forth in claim 17 which further comprises a thread stopping means on said housing for obstructing rotation of said foot out of said housing.

22. A leg support as set forth in claim 21 wherein said thread stopping means includes a stop formed at a bottom part of said internal thread of said housing and a vertical abutment surface formed at an end of said external thread of said foot.

23. A leg support as set forth in claim 17 which further comprises an end cap rotatably mounted in a lower end of said foot for transferring a load from said foot to a support surface.

24. A leg support as set forth in claim 23 which further comprises a sleeve mounted over said foot in friction fit engagement therewith and in abutment with said end cap.

25. A leg support as set forth in claim 24 wherein said sleeve on said foot has a smaller outside diameter than an inside diameter of said housing for telescoping therein.

26. A leg support comprising a longitudinally split housing defining two halves, each half containing integrally formed internal threads to define a continuous internal thread, each said housing half having a plurality of circumferentially disposed integrally formed external ribs to define continuous ribs, at least some of said ribs being of a larger outside diameter than others of said ribs;

a foot having an external thread threadably mounted in said internal thread of said housing and extending from one end of said housing, said external thread having an upper surface contacting a lower surface of said internal thread upon application of a load to said housing, and receiving the load therefrom; and a cylindrical sleeve assembled over said housing halves with said foot therein, said sleeve being retained in place by forces exerted thereon by said ribs of larger outside diameter.

27. A leg support as set forth in claim 26 wherein each said rib of larger outside diameter is tapered whereby the axial thickness thereof is less at an outer edge than at an inner edge thereof.

28. A leg support as set forth in claim 27 wherein each rib of larger outside diameter has an upper flank disposed on an angle relative to a radial plane greater than the angle of a lower flank thereof to facilitate bending thereof in response to sliding of said cylindrical sleeve thereover in a direction from said upper flank toward said lower flank.

* * * * *

UNITED STATES PATENT AND TRADEMARK OFFICE

CERTIFICATE OF CORRECTION

PATENT NO. : 6,520,461 B1
DATED : February 18, 2003
INVENTOR(S) : Thomas Graham

It is certified that error appears in the above-identified patent and that said Letters Patent is hereby corrected as shown below:

Column 9,
Line 2, change “toad” to -- load --

Signed and Sealed this

Eighth Day of April, 2003

JAMES E. ROGAN
*Director of the United States Patent and Trademark Office*